United States Patent [19]

Labriola

[11] 4,189,874

[45] Feb. 26, 1980

[54] HAND HELD POCKET SIZE SKI REPAIR AND MAINTENANCE TOOL

[76] Inventor: Daniel J. Labriola, 35 Mt. Olympus Dr. SW., Issaquah, Wash. 98027

[21] Appl. No.: 913,899

[22] Filed: Jun. 8, 1978

Related U.S. Application Data

[63] Continuation-in-part of Ser. No. 808,190, Jun. 20, 1977, abandoned.

[51] Int. Cl.[2] ..... B21K 17/00

[52] U.S. Cl. ..... 51/181 R; 76/83; 15/105; 7/158

[58] Field of Search ..... 7/158; 15/105, 236 R; 76/83, 88; 51/181 R, 205 WG, 214; 206/373, 374; 280/11.37 T

[56] References Cited

U.S. PATENT DOCUMENTS

| | | | |
|---|---|---|---|
| 1,469,643 | 10/1923 | Hovey | 15/105 |
| 2,851,712 | 9/1958 | Howard | 15/105 |
| 3,391,946 | 7/1968 | Luff | 76/83 X |
| 3,561,169 | 2/1971 | Pirzek | 76/88 X |
| 3,831,235 | 8/1974 | Weninger | 280/11.37 T X |
| 3,934,287 | 1/1976 | Howard | 51/205 WG |
| 4,054,962 | 10/1977 | Janke | 15/105 |

FOREIGN PATENT DOCUMENTS

| | | | |
|---|---|---|---|
| 723265 | 8/1942 | Fed. Rep. of Germany | 280/11.37 T |

*Primary Examiner*—Gary L. Smith

*Attorney, Agent, or Firm*—Cole, Jensen & Puntigam

[57] ABSTRACT

A hand held pocket size ski repair and maintenance tool is manipulated for reconditioning steps undertaken to refurbish the running surfaces and edges of snow skis. The various working portions of the tool are arranged in a two piece hollow body. The upper hollow piece has a cavity and the lower piece has a central rib having its own central cavity and creating two cavities. Two polishing corks are mounted in the cavity of the upper hollow piece and spaced apart to leave a space between them to accommodate the central rib of the lower hollow piece. Two abrasive stones, for deburring ski edges and removing scratches are respectively mounted adjacent the two corks in the cavity of the upper hollow piece. A file to rework the vertical and horizontal surfaces of ski edges is fitted to the central rib of the lower piece. An outside edge, located generally on the lower piece, is used in scraping operations. An outside square corner, generally on the upper piece, is included for scraping operations. Another outside corner on the upper piece is rounded and used in scraping of half-round grooves.

16 Claims, 4 Drawing Figures

HAND HELD POCKET SIZE SKI REPAIR AND MAINTENANCE TOOL

BACKGROUND OF THE INVENTION

This application is a continuation-in-part of U.S. Patent application Ser. No. 808,190, filed June 20, 1977 by Daniel J. Labriola for "Hand Held Pocket Size Ski Bottom and Edges Repair and Maintenance Tool", now abandoned.

Skiers need to have their ski running surfaces and edges well maintained by experts in ski shops and/or by themselves. Both cross country skiers and downhill skiers need corks and scrapers for preparing the running surfaces of skis with a uniform layer of a selected ski wax. Moreover downhill skiers need files and stones for sharpening and smoothing the edges of skis which are used in the stopping and turning maneuvers, especially when the weather is producing icing conditions. Tools, both hand and shop, have been provided in the past. For example, Rudolf Luff in his U.S. Pat. No. 3,391,946 discloses his combined ski file and camber-polishing block. Although the file retracts into a recess, the exterior of the block serving as a polishing block remains exposed. Emil Hanauer in his U.S. Pat. No. 3,991,429 illustrates and describes his apparatus for sharpening the edges of skis. A file is carried by a body of the tool which has an extended handle in turn equipped with a scraper. The file and scraper remain exposed at all times and no buffing or smoothing stones are provided. Fritz Gern in his U.S. Pat. No. 3,621,571 discloses his ski dresser tool for repairing and maintaining metallic ski surfaces. His tool is not used for other maintenance operations. Peter Weninger in his U.S. Pat. No. 3,381,235, illustrates and describes his file for sharpening ski edges. No other function is performed with his tool. Bennie P. Buttafucco in his U.S. Pat. No. 3,875,825, illustrates and discloses his ski sharpener which is used only to sharpen the metallic edges and surfaces of skis all at the same time. No buffing or polishing of the ski running surfaces is undertaken. Rudolf H. Thielemann Jr., in his U.S. Pat. No. 3,816,863 discloses his multipurpose ski tool having its own side metal edges and a narrow metal tip, and opposite thereto a plastic scraper. The narrow metal tip is used as a screwdriver. The side metal edges of this tool are used as scrapers on the metal edges of skis and the other wide and plastic scraper is used on the plastic and/or wood surfaces of skis.

Although all of these tools perform their respective effective functions none are arranged to conceal their working parts, so the tool may be conveniently carried in luggage and/or in pockets. Nor do any of these tools perform all the functions needed. Several have to be used to file and smooth metallic edges, and scrape and polisy nonmetallic surfaces. In contrast, this hand held pocket size tool upon opening and its subsequent use performs all the necessary operations to repair and to maintain the ski bottoms and edges.

SUMMARY OF THE INVENTION

All of the tools used by skiers or by expert ski servicing personnel in maintaining either cross country skis or downhill skis, are essentially concealed, in respective embodiments, within a small two piece hollow hand-held body conveniently carried in the skiers pocket and luggage, without soiling or damaging his or her clothes. In the preferred embodiment of the two piece hollow hand held body, the upper piece has a cavity substantially filled on each side of the center with a cork and stone leaving a central clear space. The lower piece has a central rib having its own central recess to receive a file and to the left and right are respective cavities. Upon assembly of the top and bottom pieces the respective cavities receive the respective corks, stones and the file. On the inside of the ends of the file and on the outside of the body, scrapers are arranged for initially distributing the applied wax across the board ski running surfaces, and for removing excess wax from the ski bottom grooves of whatever shape. The scrapers also remove excess base repair material when cuts and gouges in the ski base are being repaired. During all hand operations, a piece of the body with one of its tools is conveniently gripped in the fingers of one hand and oriented and moved, so the tool is effectively used. During filing, deburring, and stone polishing of the ski edges, the structure of the respective body piece also serves as a guide, while slightly bearing against the ski, to maintain the ninety degree angles which are required in creating the sharp edges of the downhill skis. After use, the respective upper and lower pieces may be lightly tapped to clean them out, and thereafter, they are assembled to await the next repair and maintenance operations. The hand held pocket size ski bottom and edges repair and maintenance tool is conveniently carried in one's garment pocket or in one's luggage without soiling or harming the garment or the clothes carried in traveling luggage.

DESCRIPTION OF THE DRAWINGS

A preferred embodiment of the hand held and used pocket size ski repair and maintenance tool operated for selected, successive, interrelated reconditioning steps undertaken to refurbish the running surfaces and edges of snow skis, is illustrated in the drawings, wherein.

DESCRIPTION OF THE PREFERRED EMBODIMENTS

Figure 1:
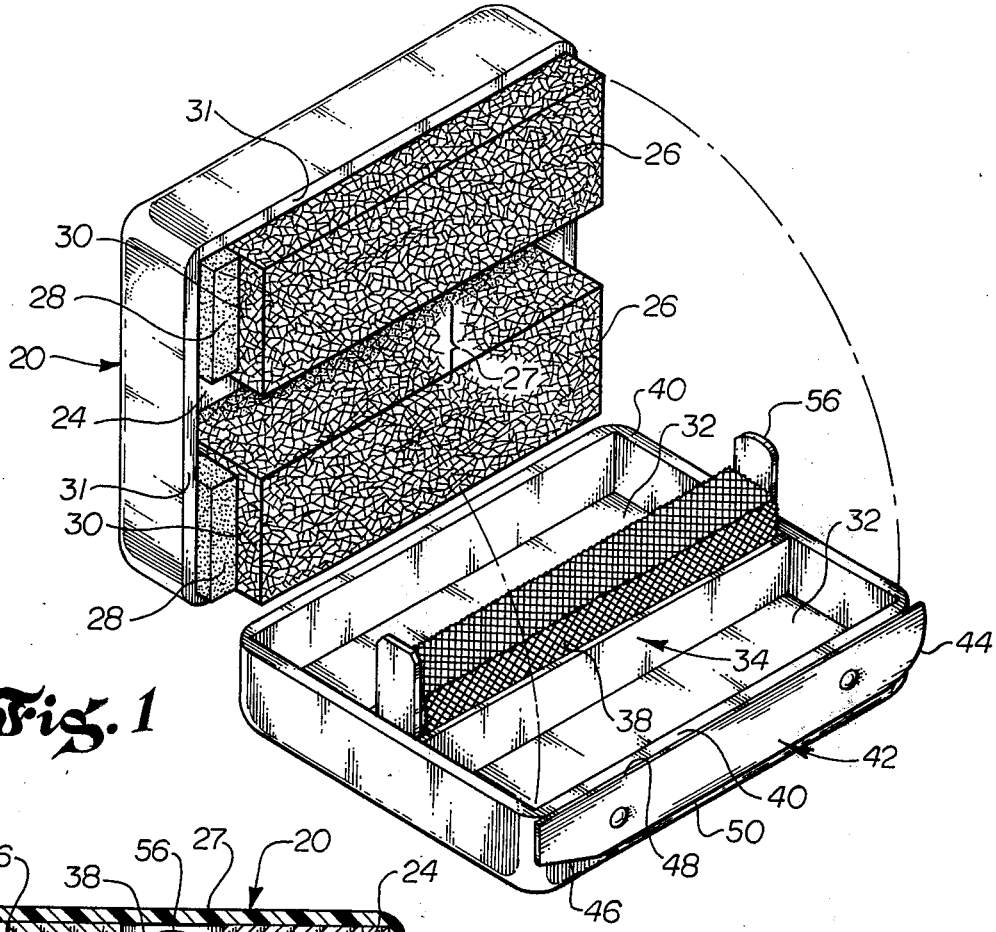
FIG. 1 is a perspective view of both sections of the pocket size ski repair and maintenance tool as it appears with the upper section pivoted away from the lower section.
Figure 2:
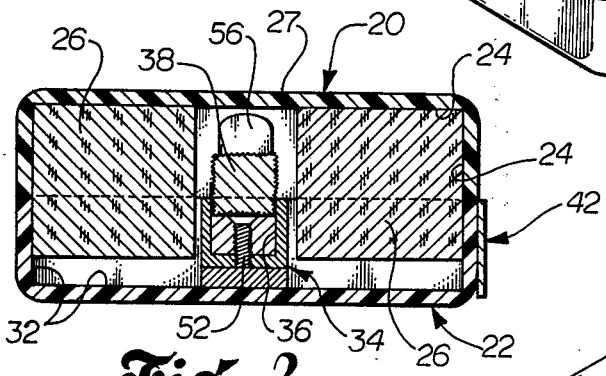
FIG. 2 is a vertical cross-sectional view of the repair and maintenance tool showing the arrangement of parts with the upper and lower body sections joined.
Figure 3:
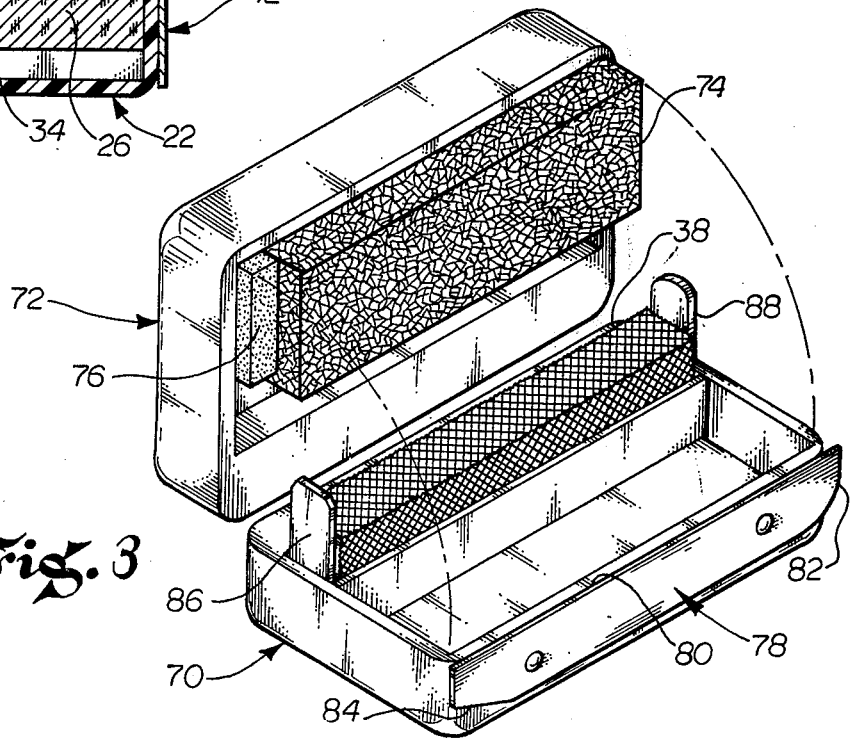
FIG. 3 is a perspective view of an alternative embodiment of the invention showing a single cork and stone.
Figure 4:
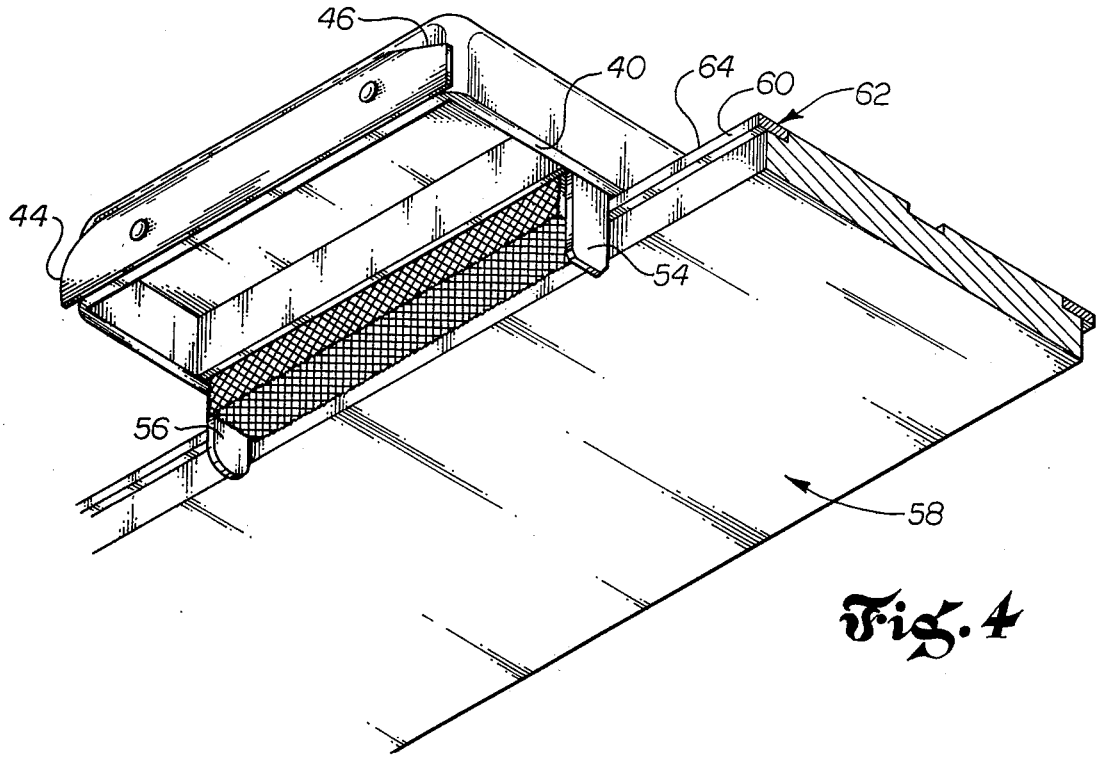
FIG. 4 is a perspective view of the invention illustrating use of the tool to file the edges of the skis.

With respect to the drawings of the various embodiments of the hand held pocket size ski repair and maintenance tool, the preferred embodiment for use in conjunction with downhill snow skis is illustrated throughout FIGS. 1, 2 and 4. FIG. 3 illustrates how the interior cork and stone tool materials may be reduced in number and rearranged in a slightly different embodiment.

FIG. 1 shows the upper and lower pieces separated to illustrate how the interior tool materials are arranged, and FIG. 2 indicates the manner in which the two body portions fit together. The upper section of the body is generally designated by the number 20 and the lower section by the number 22, both of which can be seen to be hollow rectangular members.

The upper body section 20 receives corks 26 on either side of the cavity 24. At one end of each of the corks 26 are debarring stones 28. They are spaced apart like the corks to define center recess 27 within the cavity 24. The corks 26 and stones 28 depend below the separation surfaces 31 of the upper body piece 28 to be effectively used with the corks 26 depending more than the stones. In this way, the end surfaces 30 of the corks which are adjacent the stones are able to act as guides if desired while the stones are being used on the ski metal edges.

The lower body section 22 is also a hollow rectangular housing having inside cavity 32 containing a central rib structure generally designated by the number 34. The rib 34 may take many forms such as an aluminum "U" member which provides an elongated recess 36 in which is received square file 38. Note that file 38 has filing surfaces on all four sides thereof and that three sides of the file are exposed so that the bottom surface of the ski can be filed. The file 38 is tightly but removably fitted into recess 36 in a position perpendicular to the separation surfaces 40 of the lower hollow piece 22 and it extends up above these separation surfaces 40.

The lower hollow piece 22 has an external scraping blade member 42 attached as by rivets to the outside with one end thereof being rounded as at 44 and the opposite end being shaped with a straight angled surface as at 46. Obviously the top edge 48 and the bottom edge 50 may also be used as scraping edges. It will be appreciated that the function of the blade may also be accomplished by machining the outside surface of the body to the sharp edge shape ascribed to the external blade 42 thus making the separate blade member as shown unnecessary. The central rib 34 may be held in position as by screws as shown in FIG. 2 or it may be secured in place by other means. For instance, if the rib 34 is H-shaped aluminum the scraping tabs 54 and 56, shown to be straight and rounded respectively at their outer ends, can be made of plastic material like the body and fused to the inside surface of the body so that the H-shaped rib is securely held in place. The tabs 54 and 56 also function as guides where the top surface of the file 38 is being used.

The two sections of the tool are manipulated, generally one at a time, in one hand of the skier or a person in a ski shop, to repair and to maintain the edges of the skis and also the bottom running surfaces. The lower piece 22 with the protruding file 38 can be inverted so that body edge 40 bears on the running surface and one side of the file brought to bear on the metal edge and moved from the tip to the end of the ski 58 to sharpen the side surface 60 of metal edge 62. See FIG. 4. Most edges 62 are metallic and their sharp ninety degree corner 64 aids the skier on ice and near ice packed snow slopes during downhill and slalom runs. Accordingly, it will be understood that by repositioning the tool the bottom surface of the edge 62 can also be filed to sharpen the corner edge 64. Since the file 38 also has a top filing surface, the running or bottom surface of the ski and the metal edges can be filed together to give a smooth planar surface for improved ski performances. The tabs, of course, also act as guides to prevent the file surface from running off the ski and metal edges.

In like manner, the stones 28 in the upper piece 20 are positioned and moved to deburr and polish the edge 62 which generally have been previously filed, as shown in FIG. 4. Again by moving the upper piece 20 through ninety degrees the respective side surface 60 and bottom surface thereof are both deburred and polished. In like manner, the scraper edges of scraper 42 can be used to remove excess wax by hand applying that section of the tool at an angle.

The removal of excess wax and often the redistribution of the wax from the groove in the bottom of the skis is undertaken by ends 44 and 46 of the external scraper or by tabs 54 and 56. In the sharp cornered grooves the sharp corner 46 of the lower hollow piece 32 is used. If the groove has rounded corners, the round corner 44 or tab 56 of the hollow piece 32 would be used. Final polishing is accomplished by using the corks 26 wherein the upper piece is moved along the running surfaces of the ski with the corks firmly pressed against the waxed coating. The stones 28 are positioned to be clear of the running surfaces both by their end position and their smaller depth dimensions. During all these repair and maintenance operation the fingers of one hand conveniently manipulate this hand held pocket side ski repair and maintenance tool.

In FIG. 3, the file 38 is repositioned to one side in lower body section 70 as shown. In the upper section 72 only one cork 74 and only one stone 76 are used and positioned to clear the file 38 in its side position. In FIG. 4, the added scraper member 78 generally metallic is bonded or riveted to the lower molded body section 70, to provide the scraping edge 80, the rounded corner 82 and the sharp corner 84, all used in the scraping, removal, and/or redistribution of the ski wax. Note also that tabs 86 and 88 are provided at each end of the file 38 as described above.

What is claimed is:

1. A hand held and used pocket size ski repair and maintenance tool operated for selected reconditioning steps undertaken to refurbish the running surfaces of snow skis, comprising:

(a) a two piece hollow, hand-held body with surrounding sides transversely separable across a major cross section, the upper hollow piece having a cavity, and the lower hollow piece having a cavity;

(b) cork material as a tool for polishing the bottoms of skis, mounted in the cavity of one of the hollow pieces and sized to leave a space to accommodate other tools and to extend down into a cavity of the other hollow piece;

(c) abrasive stone material for deburring ski edges and removing scratches, mounted adjacent the cork material and sized to be extended a shorter distance down into a cavity of the other hollow piece; and (d) file means to file both the vertical and horizontal surfaces of ski edges and bottom fitted into the cavity of the other hollow piece and sized to extend alongside the cork material and the abrasive stone material positioned in said one hollow piece of said tool.

2. The hand held and used pocket size ski repair and maintenance tool, as claimed in claim 1, having in addition an outer edge surface on one hollow piece to form a ski surface scraping edge surface to be used in removing excess wax or excess repair compounds from a ski bottom.

3. The hand-held and used pocket size ski repair and maintenance tool as set forth in claim 1 and wherein guide tab means are provided at at least one end of said file means and extending outwardly beyond the outermost surface of said file means.

4. The hand held and used pocket size ski repair and maintenance tool, as claimed in claim 1, having in addition an outer corner of one hollow piece being an abrupt corner with all meeting surfaces maintained at right angles to present a corner structure to be used to scrape a longitudinal rectangular or a vee grooves in the bottom of a ski to remove excess wax or excess repair compounds.

5. The hand held and used pocket size ski repair and maintenance tool, as claimed in claim 1, having in addition an outer corner of one hollow piece being rounded to be used to scrape a longitudinal curved bottom groove in the bottom of a ski to remove excess wax or excess repair compounds.

6. The hand held and used pocket size ski repair and maintenance tool as set forth in claim 1 and wherein said file means is generally rectangular in cross-section and detachably held in the cavity of said other hollow piece and positioned so that three filing surfaces are presented for use.

7. A hand held and used pocket size ski repair and maintenance tool operated for selected reconditioning steps undertaken to refurbish the running surfaces of snow skis, comprising:

(a) a two piece hollow hand held body with surrounding sides transversely separable across a major cross-section; the upper hollow piece having a cavity, and the lower hollow piece also having a cavity including central rib creating two cavities;

(b) two corks, for polishing the bottoms of skis, mounted in the cavity of the upper hollow piece and sized to leave a space between them to accommodate the central rib of the lower hollow piece and also to leave space at one end of each of them, and to extend down into the two respective cavities of the lower hollow piece;

(c) two abrasive stones, for deburring ski edges and removing scratches, mounted adjacent the respective ends of the respective corks in the cavity of the upper hollow piece, and sized to be extended a shorter distance down into the two respective cavities of the lower hollow piece and to also accommodate the central rib of the lower hollow piece; and (d) a file means to file both the vertical and horizontal surfaces of ski edges and bottom fitted into the central cavity of the central rib of the lower hollow piece and sized to extend above the central rib yet remain within the space between the two corks and two abrasive stones positioned in the upper hollow piece.

8. The hand held and used pocket size ski repair and maintenance tool as claimed in claim 7 having in addition an outer beveled edge surface on the lower hollow piece to form a ski surface scraping beveled edge surface to be used in removing excess wax or excess repair compounds from a ski bottom.

9. The hand held and used pocket size ski repair and maintenance tool, as claimed in claim 7, having in addition an outer corner of the upper hollow piece being an abrupt corner with all meeting surfaces maintained at right angles to present a corner structure to be used to scrape a longitudinal rectangular or a vee groove in the bottom of a ski to remove excess wax or excess repair compounds.

10. The hand held and used pocket size ski repair and maintenance tool as set forth in claim 7 and wherein guide tab means are provided at at least one end of said file means and extending outwardly beyond the outermost surface of said file means.

11. The hand held and used pocket size ski repair and maintenance tool, as claimed in claim 7, having in addition an outer corner of the upper hollow piece being rounded to be used to scrape a longitudinal curved bottom groove in the bottom of a ski to remove excess wax or excess repair compounds.

12. The hand held and used pocket size ski repair and maintenance tool as set forth in claim 7 and wherein said file means is generally rectangular in cross-section and detachably held in the cavity of said other hollow piece and positioned so that three filing surfaces are presented for use.

13. A hand held and used pocket size ski repair and maintenance tool operated for selected reconditioning steps undertaken to refurbish the running surfaces of snow skis, comprising:

(a) a two piece hollow hand held rectangular body having uniform planar outer top and outer bottom surfaces with surrounding like thickness sides transversely separable across a near midway major cross-section, the upper hollow piece having a full unobstructed rectangular interior cavity, and the lower hollow piece having a central longitudinal rib separating two alike rectangular interior cavities, with this central longitudinal rib having its own central interior cavity;

(b) two rectangular corks for polishing the bottoms of skis mounted longitudinally in the full unobstructed rectangular interior cavity of the upper hollow piece and sized to leave a space between them to accommodate the central longitudinal rib of the lower hollow piece, and to leave a space at at least one of their alike aligned ends, and to extend down into the two respective alike rectangular interior cavities of the lower hollow piece;

(c) two rectangular abrasive stones for deburring ski edges and removing scratches mounted longitudinally adjacent the two rectangular corks in the remaining spaces of the initially full unobstructed rectangular interior cavity of the upper hollow piece and sized to be extended a shorter distance down into the two respective alike rectangular interior cavities of the lower hollow piece and to also accommodate the central longitudinal rib of the lower hollow piece; and (d) a rectangular file to file both the vertical and horizontal surfaces of ski edges and bottom frictionally fitted into the central interior cavity of the central longitudinal rib of the lower hollow piece and sized to extend above the central longitudinal rib yet remain within the space between the two rectangular corks and two rectangular abrasive stones secured within the upper hollow piec, said file having filing surfaces on at least three sides and mounted such that at least three filing surfaces are exposed for use.

14. The hand held and used pocket size ski repair and maintenance tool, as claimed in claim 13, having in addition an outer beveled longitudinal edge surface to remove excess wax or excess repair compounds from a ski bottom.

15. The hand held and used pocket size ski repair and maintenance tool, as claimed in claim 13, having in addition, an outer corner of the upper hollow piece being an abrupt corner with all meeting surfaces maintained at right angles, to present a corner structure to be used to scrape a longitudinal rectangular or a vee groove in the bottom of a ski to remove excess wax or excess repair compounds.

16. The hand held and used pocket size ski repair and maintenance tool, as claimed in claim 13, having in addition, an outer corner of the upper hollow piece being rounded to be used to scrape a longitudinal curved bottom groove in the bottom of a ski to remove excess wax or excess repair compounds.

* * * * *